US006343960B1

(12) United States Patent
Sato

(10) Patent No.: US 6,343,960 B1
(45) Date of Patent: Feb. 5, 2002

(54) JOINT CONNECTOR HAVING HOUSING BODIES IN STACKS

(75) Inventor: Kei Sato, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/905,107

(22) Filed: Jul. 16, 2001

(30) Foreign Application Priority Data

Jul. 17, 2000 (JP) ..... 12-216539

(51) Int. Cl.[7] ..... H01R 13/502
(52) U.S. Cl. ..... 439/701; 439/660
(58) Field of Search ..... 439/701, 660, 439/714, 715, 717, 721, 723

(56) References Cited

U.S. PATENT DOCUMENTS 3,611,270 A * 10/1971 Eppler ..... 439/701
5,320,555 A * 6/1994 Okabe ..... 439/701
6,022,247 A * 2/2000 Akiyama et al. ..... 439/701
6,068,519 A * 5/2000 Lok ..... 439/660

FOREIGN PATENT DOCUMENTS

JP P 2000-150055 1/1994
JP UM 6-2570 5/2000

* cited by examiner

*Primary Examiner*—P. Austin Bradley
*Assistant Examiner*—Briggitte R. Hammond
(74) *Attorney, Agent, or Firm*—Finnegan, Henderson, Farabow, Garrett & Dunner, L.L.P.

(57) ABSTRACT

A joint connector 13 is provided to improve workability in piling a plurality of housing bodies. The connector 13 includes a plurality of housing bodies 15 each having a plurality of terminal accommodating grooves 19, a plurality of terminals 17 accommodated in the terminal accommodating grooves 19, the neighboring terminals 17 being connected with each other through a linking part 45 and an alignment mechanism 23 for guiding the other housing bodies 15 to respective formal stacking positions. Each terminal 17 has a contact piece 53 projecting out of the housing body 15 selectively and a connecting part 55 for connection with the contact piece 53 of the other housing body 15 under the housing body 15.

8 Claims, 15 Drawing Sheets

JOINT CONNECTOR HAVING HOUSING BODIES IN STACKS

BACKGROUND OF THE INVENTION

1. Field of the Invention

The present invention relates to a joint connector having housing bodies piled on each other by their slide movements.

2. Description of the Related Art

Japanese Unexamined Patent Publication No. 12-150055 discloses a conventional joint connector which includes a plurality of housing bodies piled on each other in multistage and a plurality of terminals accommodated in each of the housing bodies.

Juxtaposed in each housing body are a plurality of terminal accommodating grooves that accommodate the terminals, respectively. Note, in this joint connector, one terminal accommodated in the housing body has a contact piece formed on its underside to project out of the housing body and a connecting part formed for connection with the contact piece of the other terminal in the other housing body mounted on the above housing body.

In the so-constructed joint connector, the pile of plural housing bodies in multistage is carried out by the following steps. First, align the connecting parts of the terminals accommodated in one housing body with the contact pieces of the other housing body on the upside, which will be referred "upper housing body" hereinafter. Correspondingly, the former housing body will be referred "upper housing body", hereinafter. In his state, move the upper housing body downward and subsequently mount it on the lower housing body thereby to form one pile. Then, the contact pieces of the upper housing body are respectively inserted into the connecting parts of the lower housing body, thereby effecting the mutual connection of the terminals of the housing bodies in pile.

However, the above-mentioned aligning work is troublesome for a worker, taking a great deal of time in assembling the housing bodies. Conversely, if the assembling is performed while abolishing the aligning work, then there arises a possibility that the contact pieces of the upper housing body are assembled into the connecting parts of the lower housing body with deviations, causing one or more contact pieces of the former body to abut on the upper face of the latter body to damage.

SUMMARY OF THE INVENTION

Under the circumstances, it is therefore an object of the present invention to provide a joint connector which is capable of improvement of the workability in assembling the housing bodies to each other and which does not cause the contact pieces of the housing body to be damaged due to erroneous assembling.

The object of the present invention described above can be accomplished by a joint connector comprising:

a plurality of housing bodies adapted to be piled on each other, the housing bodies each having a plurality of terminal accommodating grooves juxtaposed therein;

a plurality of terminals accommodated in the terminal accommodating grooves of the housing bodies, respectively, wherein at least one of the terminals is connected with the neighboring terminal through a linking part, the terminals for each of the housing bodies having respective contact pieces formed to project out of a related housing body selectively and also having respective connecting parts formed for connection with the contact pieces of a lower housing body which is arranged under the related housing body; and an alignment mechanism formed for each of the housing bodies to guide the other housing bodies arranged over and under the related housing body to respective formal stacking positions established thereon.

In the joint connector constructed above, the terminals are respectively accommodated in the terminal accommodating grooves of each of the housing bodies. Further, the other housing bodies arranged over and under the related housing body are guided to the formal stacking position by the alignment mechanism. Then, the contact pieces of the terminals in the related housing body are selectively connected with the connecting parts of the terminals in the other housing body piled on the related housing body.

As the second aspect of the invention, in the above joint connector, the alignment mechanism comprises:

guide rails formed on the related housing body to guide the upper housing body piled thereon; and guide grooves formed in the related housing body, for slide engagement with the guide rails of the lower housing body arranged under the related housing body, thereby to allow the lower housing body to be guided to the formal stacking position.

With the alignment mechanism constructed above, the guide rails of the other housing body arranged under the related housing body slide along the guide grooves of the related housing body, so that the former housing body can be brought into the formal stacking position.

As the third aspect of the invention, the guide rails of the lower housing body are engaged in the guide grooves of the related housing body, thereby completing a condition where the related housing body is arranged over the lower housing body.

As the fourth aspect of the invention, there is also established a sliding direction of the guide rails between the guide grooves of the related housing body and the guide rails of the lower housing body engaging the guide grooves, the sliding direction intersecting respective longitudinal directions of the terminals.

In this arrangement, the lower housing body is slid under the related housing body and brought into the formal stacking position along the direction intersecting the longitudinal directions of the terminals.

As the fifth aspect of the invention, the contact pieces of the related housing body are connected with the connecting parts of the terminals accommodated in the upper housing body arranged over the related housing body, elastically.

In this arrangement, when the upper housing body is guided to the formal stacking position, the contact pieces of the terminals in the related housing body are elastically connected with the connecting parts of the terminals in the upper housing body.

As the sixth aspect of the invention, the contact pieces of the terminals accommodated in the related housing body are provided, thereon, with projections for electrical connection with the connecting parts of the terminals accommodated in the upper housing body.

In this arrangement, when the upper housing body is guided to the formal stacking position, the contact pieces of the terminals in the related housing body are displaced to the side of the related housing body. Additionally, since the projections on the contact pieces come in slide contact with the upper housing body, it is possible to reduce contact area between the contact pieces and the upper housing body in comparison with the case of no projection.

As the seventh aspect of the invention, each of the contact pieces of the terminals has a drawer part formed to project out of the related housing body and an inserting part formed in succession with the drawer part toward the linking part and each of the connecting parts is adapted so as to come into elastic abutment with the inserting part of the terminals in the lower housing body arranged under the related housing body.

In this case, when the lower housing body is guided to the formal stacking position on the related housing body, the connecting parts of the related housing body come into elastic abutment with the inserting part of the terminals in the lower housing body.

As the eighth aspect of the invention, the linking part has a linking piece and a press-fit piece allowing the linking piece of the neighboring terminal to insert thereinto to link the terminal to the neighboring terminal.

In this arrangement, when the terminals are respectively accommodated in the terminal accommodating grooves of the housing body, each linking piece is inserted into the press-fit piece of the adjoining terminal under pressure.

These and other objects and features of the present invention will become more fully apparent from the following description and appended claims taken in conjunction with the accompany drawings.

DESCRIPTION OF THE PREFERRED EMBODIMENT

Embodiments of the present invention will be described with reference to the drawings.

1st. Embodiment

Figure 1A:
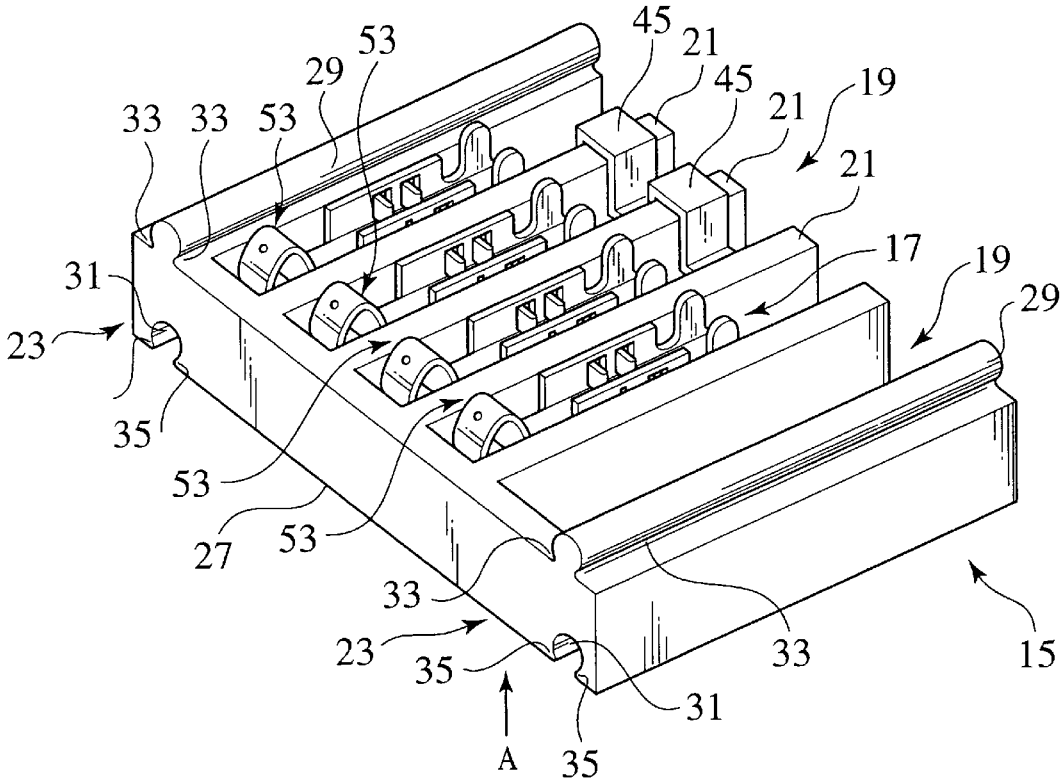
FIG. 1A is a perspective view of one housing body of the joint connector in accordance with the first embodiment of the invention.
Figure 1B:
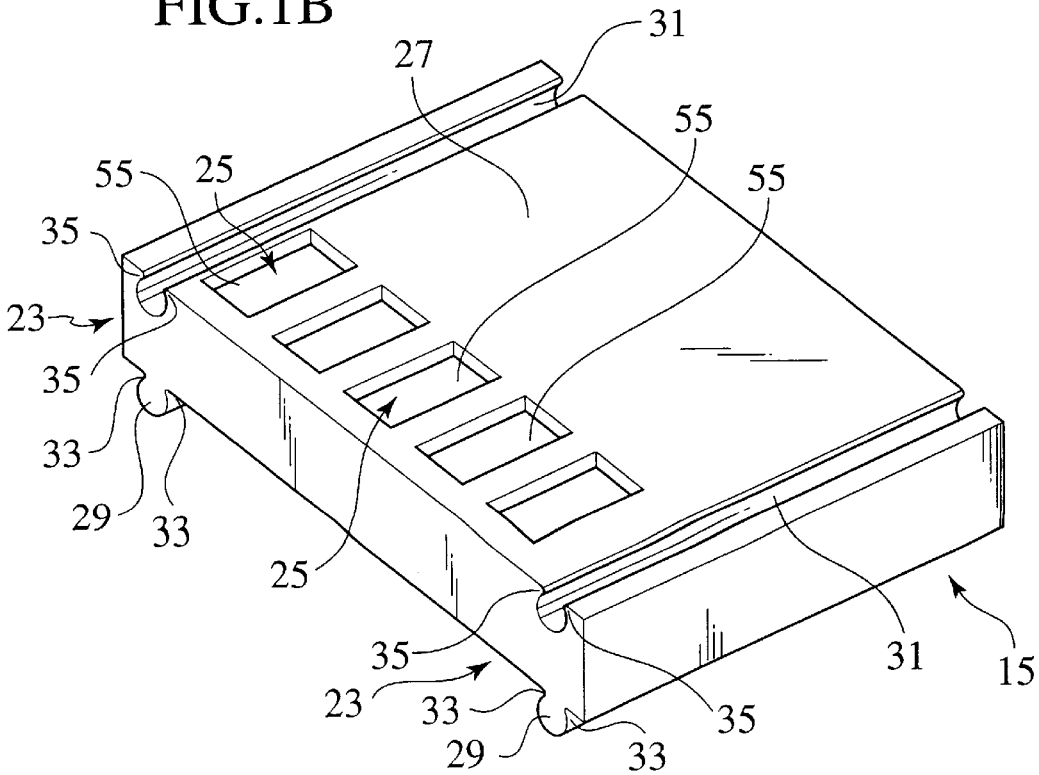
FIG. 1B is a perspective view of the housing body of FIG. 1A, also viewed from a direction of arrow A in the same figure.

In these figures, FIG. 1A is a perspective view of one housing body forming a joint connector in accordance with the first embodiment of the invention. FIG. 1B is another perspective view of the housing body, also viewed from a direction of arrow A of FIG. 1A.

As shown in FIGS. 1A and 1B, the joint connector 13 comprises a plurality of housing bodies 15 (only one shown in the figure) to be piled on each other in multistage and a plurality of terminals 17 built in each housing body 15 so that the adjoining terminals 17 therein are selectively connected with each other. Electrical wires are connected with these terminals 17, respectively. Therefore, some of the electrical wires are connected with each other through the terminals 17 on selection.

In FIG. 1A, the housing body 15 is box-shaped to have a plurality of terminal accommodating grooves 19 formed therein, partitions 21 for defining the grooves 19 and an alignment mechanism 23 for guiding the other housing body, which is to be piled on the body 15, to its formal stacking position.

The terminal accommodating grooves 19 are arranged in parallel with each other and also provided with respective openings facing the upper face of the housing body 15. At the end of each terminal accommodating groove 19 in the longitudinal direction, it has an opening into which the terminal 17 is inserted and which are defined by the opposing partitions 21. Further, as shown in FIG. 1B, the housing body 15 is provided, at a bottom thereof, with a plurality of rectangular insertion holes 25 which penetrate a lower face 27 of the body 15.

The housing body 15 further includes an alignment mechanism 23. The mechanism 23 comprises a pair of guide rails 29, 29 formed on both sides of the body 15 to extend in the longitudinal direction and a pair of guide grooves 31, 31 formed as well as the rails 29, 29. In the form of projections having constant sections, the guide rails 29, 29 are formed on the upper face of the housing body 15 integrally and also arranged in parallel with each other. Further, each guide rail 29 is provided, on its root, with opposing recesses 33, 33.

Similarly, the recesses 33, 33 are also formed to extend in the longitudinal direction of the guide rails 29, 29 respectively. As mentioned above, the guide grooves 31, 31 are formed on both sides of the lower face 27 to extend along a direction substantially parallel with the guide rails 29, 29. Each guide groove 31 is shaped to have a section generally equal to or somewhat larger than the section of the guide rail 29. The guide grooves 31, 31 are formed to accommodate the guide rails 29, 29 of the other housing body 15 underlying the above housing body 15, slidably. That is, each guide groove 31 is provided, on its opening side, with opposing inward projections 35, 35 in the longitudinal direction.

When the guide rails 29, 29 of the underlying (lower) housing body 15 slide in the guide grooves 31, 31 of the upper housing body 31, the projections 35, 35 engage with the recesses 33, 33 of the guide rails 29, 29 respectively. Assembled in the so-formed housing body 15 are the terminals 17 as a plural.

Figure 2:
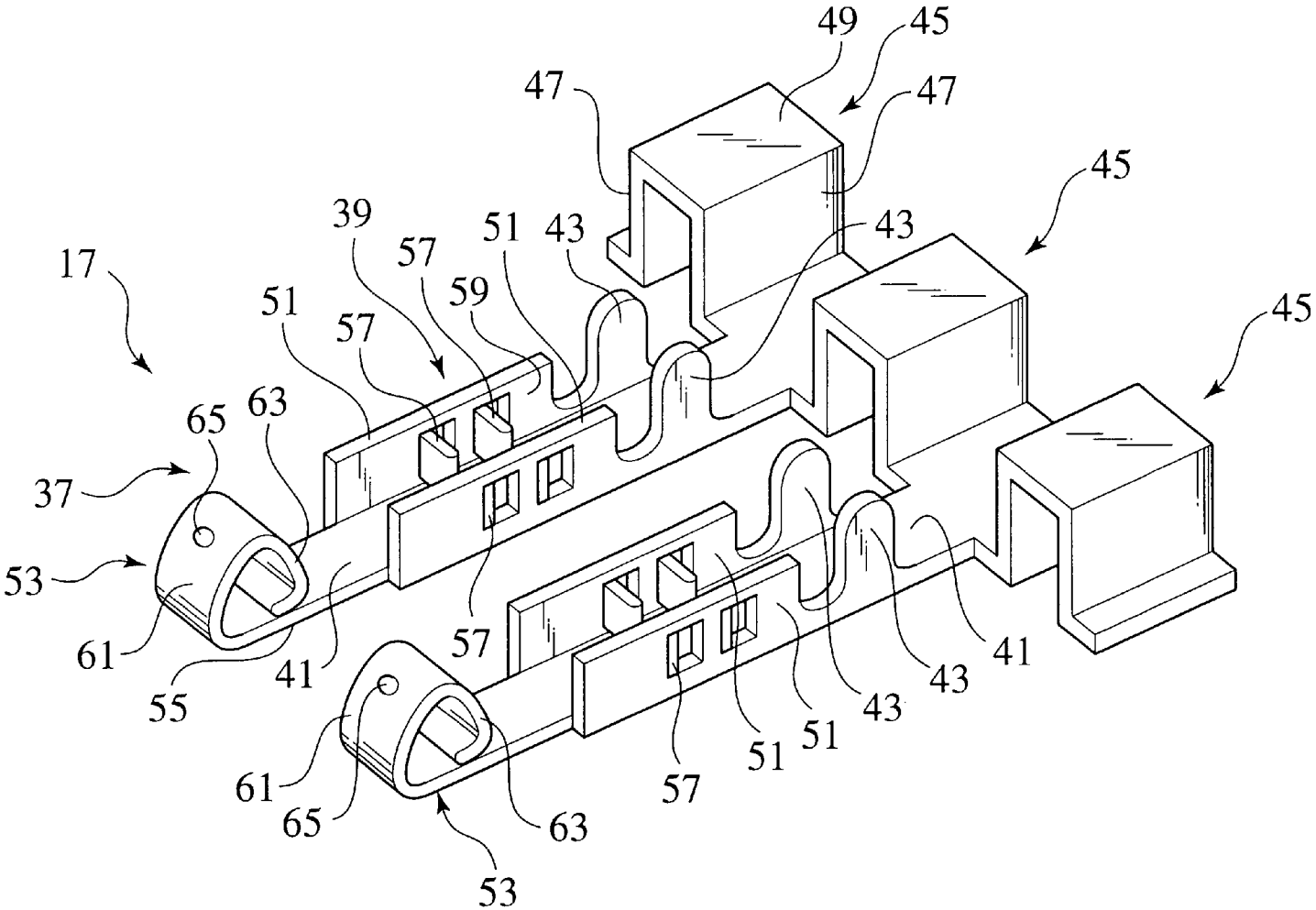
FIG. 2 is a perspective view of a terminal in the joint connector shown in FIGS. 1A and 1B.
Figure 3A:
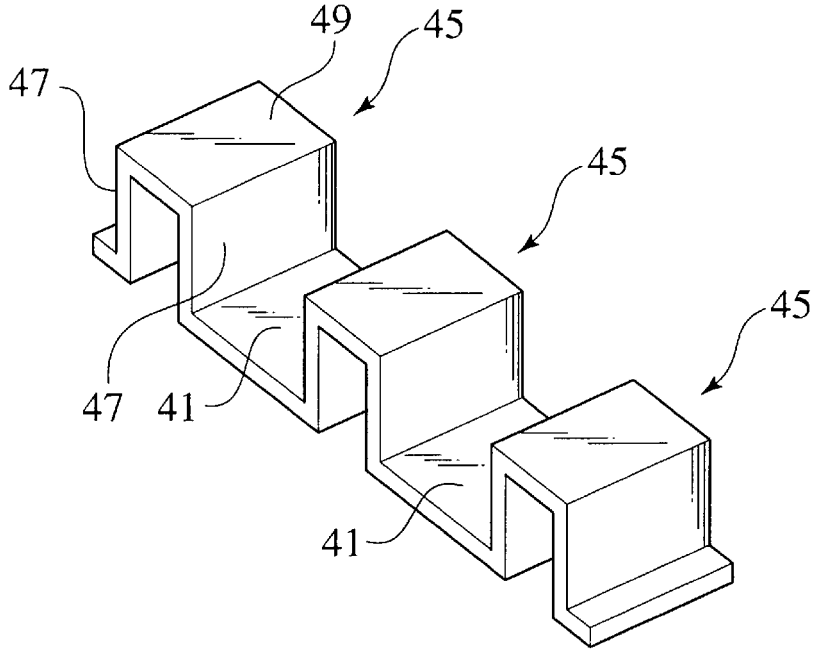
FIG. 3A is a perspective view of a connecting part of the terminal of FIG. 2.
Figure 3B:
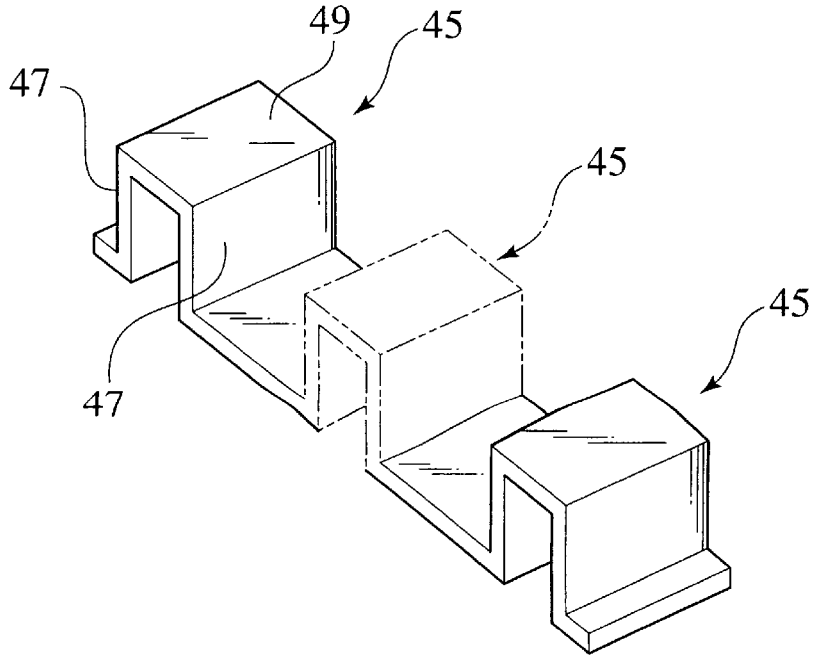
FIG. 3B is a perspective view of the connecting part of the terminal of FIG. 2, with a partial removal thereof.
Figure 4A:
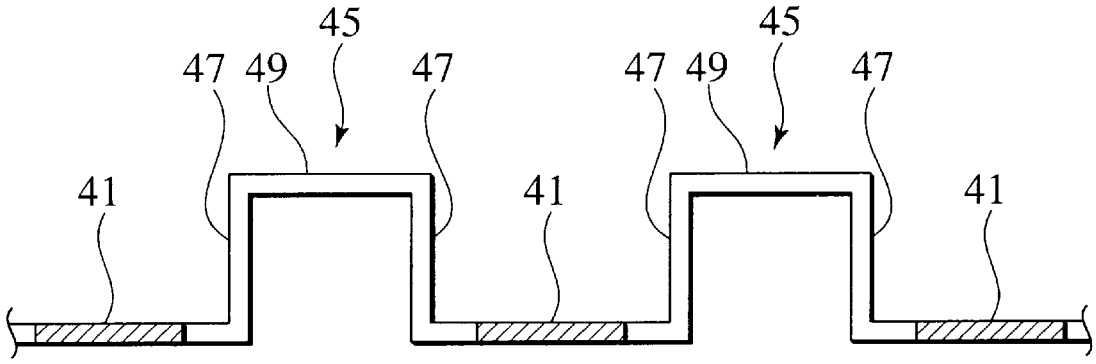
FIG. 4A is a cross-sectional view of the connecting part of FIG. 3A.
Figure 4B:
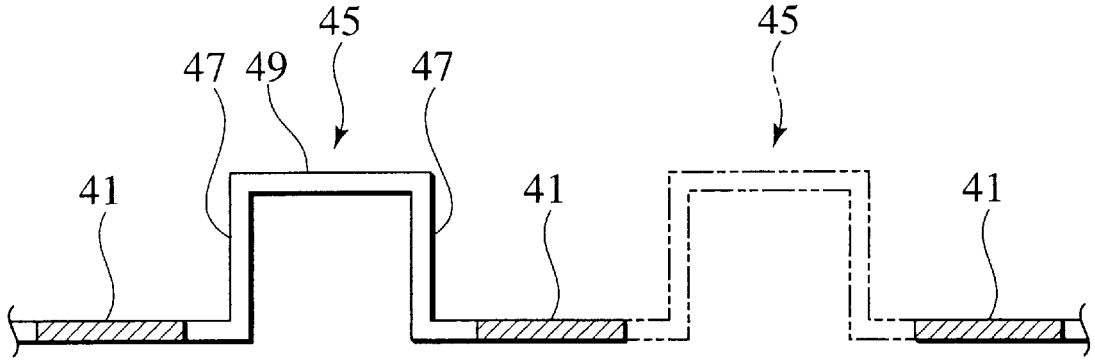
FIG. 4B is a cross-sectional view of the connecting part of FIG. 3B.

FIG. 2 is a perspective view of the terminals 17 of the joint connector 13 of FIGS. 1A and 1B. Each terminal 17 has a base part 37 formed on one hand and a contact part 39 formed on the other hand. The base part 37 has a bottom wall 41, a wire-retaining part 43 standing on the bottom wall 41 and a linking part 45 formed at the end of the bottom wall 41.

The bottom wall 41 is shaped to be rectangular and also arranged inside the lower face 27 of the housing body 15 on condition that the terminal 17 is accommodated in the terminal accommodating groove 19.

The wire-retaining part 43 has a pair of plates formed on both sides of the bottom wall 41 to oppose each other. In connecting the terminal 17 with an electrical wire (not shown), the plates of the part 43 are together bent to maintain the connection between the wire and the terminal 17.

The linking part 45 is in the form of a substantially U-shaped plate having a pair of side plates 47, 47 and a top plate 49. In the side plates 47, 47, one is formed in integral with the side face of the bottom wall 41, while the other is formed in integral with the side face of the bottom wall 41 of the adjoining terminal 17. As shown in the figure, the side plates 47 project from the bottom wall 41 upwardly and the top plate 49 bridges a gap between the opposing side plates 47 integrally. When the plural terminals 17 are assembled to the housing body 15, the so-formed linking parts 45 stride over the partitions 21 respectively.

The contact part 39 of each terminal 17 has a pair of sidewalls 51, 51 formed on both sides of the bottom wall 41 integrally, a contact piece 53 formed in one body with the bottom wall 41 and a connecting part 55 formed in succession to the contact piece 53, for connection with the contact piece (not shown) of the terminal accommodated in the other "piled" housing body underlying the related connector housing 15 (FIG. 1).

The sidewalls 51, 51 are shaped to be rectangular and arranged to oppose each other on both sides of the bottom wall 41. Each sidewall 51 is provided with a plurality of press edges 57.

The plate-shaped press edges 57 are formed by bending the sidewalls 51, 51 partially and inwardly, projecting from opposing faces 59, 59 of the sidewalls 51, 51. Having respective tips opposing each other, these press edges 57 are established so that a distance between the opposing tips is somewhat smaller than a core diameter of the electric wire (not shown).

The contact piece 53 includes a first cuff piece 61 and a second cuff piece 63. The plate-shaped cuff piece 61 is formed as if folding back the leading part of bottom wall 41, with elasticity. The first cuff piece 61 is inclined to the plane bottom wall 41 upwardly.

The second cuff piece 63 is also plate-shaped and formed as if folding back the first cuff part 61, with elasticity. That is, the second cuff piece 63 is formed so as to extend from the end of the first cuff piece 61 toward the bottom wall 41 obliquely downward. Further, the leading end of the second cuff piece 63 is folded back toward the end of the bottom wall 41, namely, the leading end of the terminal 17. The so-formed contact piece 53 represents elasticity as a whole. Note, the contact piece 53 is formed so as to partially project out of the housing body 15 through the opening of the terminal accommodating groove 19 while the terminal 17 is being accommodated in the terminal accommodating groove 19.

Each of the contact pieces 53 is provided with a projection 65. The projection 65 is shaped to have a curved surface and positioned on the first cuff piece 61.

As shown in FIG. 1B, the connecting part 55 is defined by the bottom wall (part) 41 that faces the insertion hole 25 when the terminal 17 is accommodated in the terminal accommodating groove 19 of the housing body 15.

In order to provide the joint connector 13 of the embodiment, first assemble the mutually-connected terminals 17 into each of the housing bodies 15 and thereafter, pile up the housing bodies 15 in multistage.

In detail, when assembling the terminals 15 into the plural housing bodies 15, the terminals 17 are respectively positioned between the opposing partitions 21 defining the terminal accommodating grooves 19. In this state, begin to insert the terminals 17 into the terminal accommodating grooves 19, from their sides of the contact parts 39. Then, the insertion of each terminal 17 into the terminal accommodating groove 19 is once stopped at the so-called "incomplete inserting" position where the linking part 45 is not fitted to the partition 21 sufficiently, realizing a temporary accommodating condition.

Figure 5A:
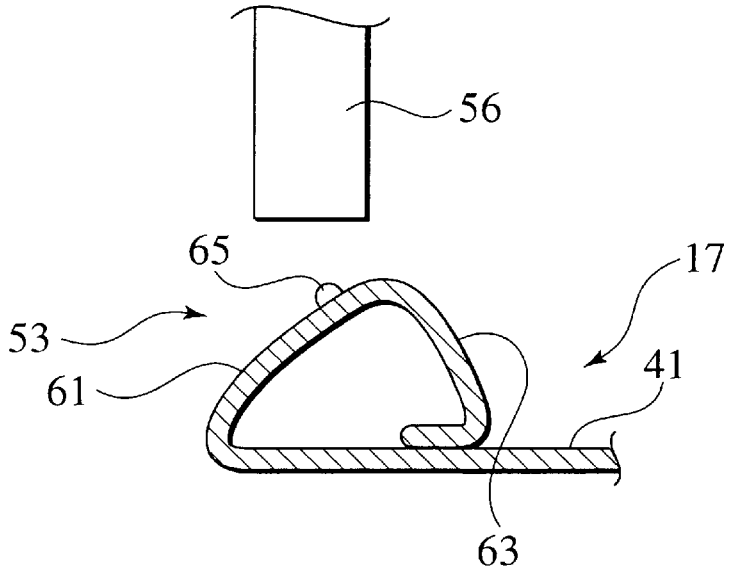
FIG. 5A is a sectional view of a main part of the contact piece of the terminal of FIG. 2, also showing before pressing the main part.
Figure 5B:
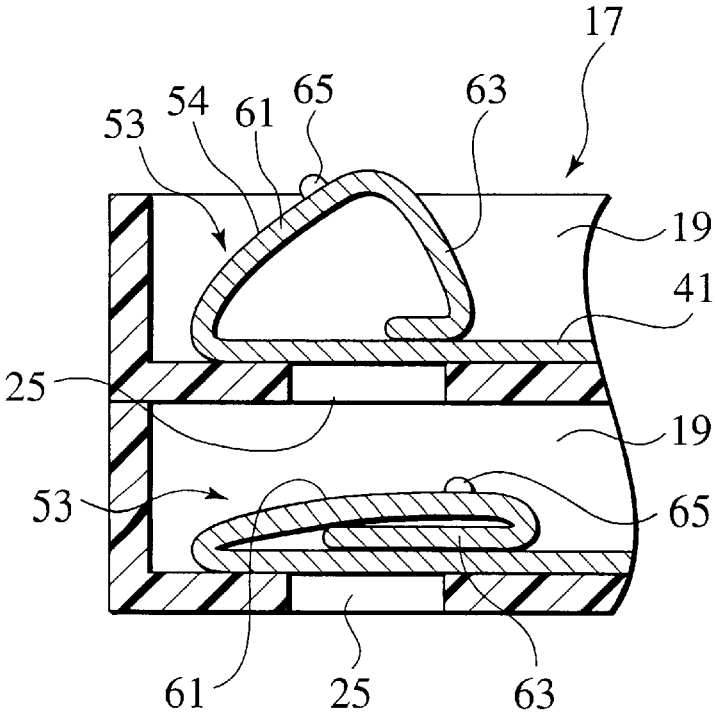
FIG. 5B is a sectional view of the main part of the contact pieces of the terminals of FIG. 2, also showing one contact piece being pressed.

Next, in accordance with the design of an electric circuit required, the linking parts 45 of the terminals 17 are selectively removed at designated positions, so that the terminals 17 in connection are separated from each other in electricity, as shown in FIGS. 3A, 3B, 4A and 4B. Additionally, in accordance with the design of the electric circuit, the designated contact pieces 53 of the terminals 17 are selectively pressed into buckle by a pressing unit 56, as shown in FIGS. 5A and 5B. After completing the operations, the whole terminals 17 are further inserted into the terminal accommodating grooves 19 into their formal inserting positions.

Subsequently, the not-shown electric wires are assembled to the terminals 17 respectively. During this assembling, each electric wire is first inserted into the terminal accommodating groove 19 through its rear opening to come in touch with the press edges 57. Then, the wire is further inserted between the opposing press edges 57, 57 under pressure. Next, bend the wire retaining parts 43 to hold the cicumferential face of the wire, maintaining a condition that the wire is connected with the terminal 17. In this way, the tips of the press edges 57 are connected with the cores of each electrical wire, completing the housing body 15 where the terminals 17 are connected with the wires. Note, depending on the design of circuit, there is a case that only the predetermined terminals 17 have the electrical wires connected thereto.

In order to pile the so-assembled housing bodies 15 in multistage, slide the guide rails 29, 29 of the lower housing body 15 into the guide grooves 31, 31 of the upper housing body 15 thereby to guide the lower housing body 15 to the formal piling position.

Figure 6:
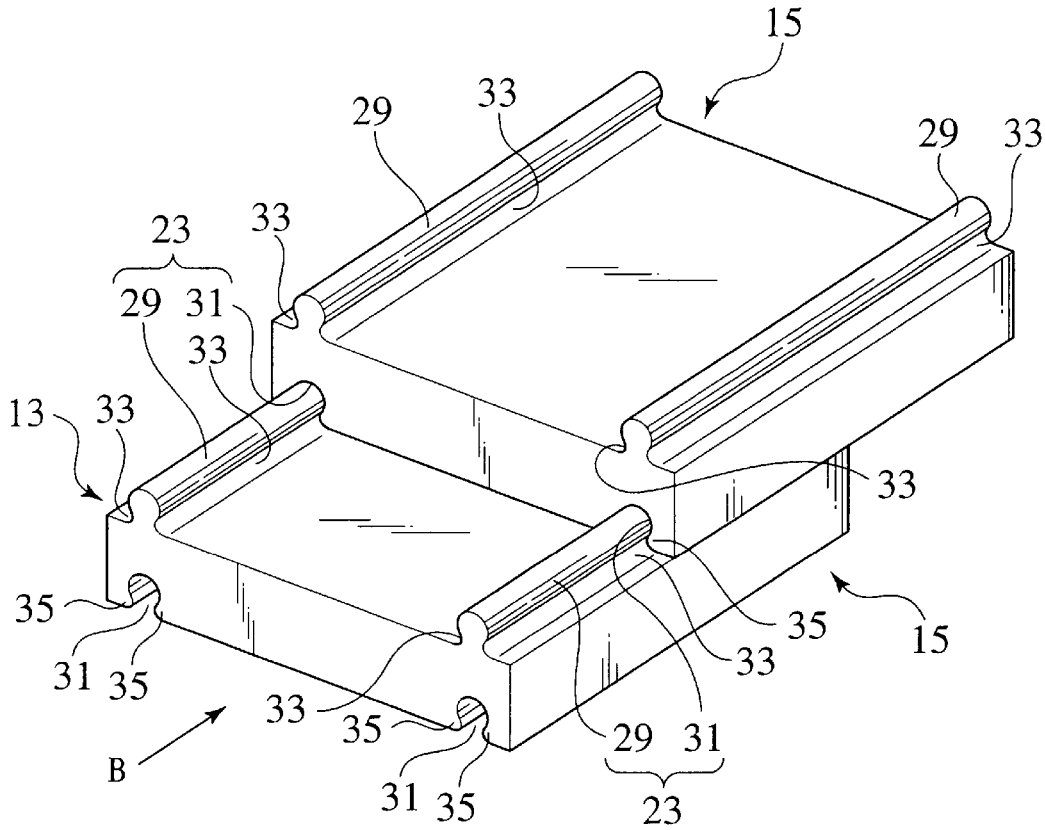
FIG. 6 is a perspective view of a condition where the housing bodies of FIG. 1 are piled on each other.

When sliding the guide rails 29, 29 of the lower housing body 15 into the guide grooves 31, 31 of the upper housing body 15, it is carried out to align the cross sections of the guide rails 29, 29 of the lower housing body 15 with those of the grooves 31, 31 with advance movement of the wires (not shown) assembled to the housing body 15 out of the same body's way. Under this situation, press the lower housing body 15 in the direction of arrow B thereby to insert the guide rails 29, 29 into the guide grooves 31, 31 respectively, as shown in FIG. 6 (note: there are not shown the terminal accommodating grooves 19 and the terminals 17 accommodated therein in this figure). Then, the recesses 33 of the guide rails 29, 29 of the lower housing 15 are respectively engaged with the projections 35, 35 of the grooves 31, 31 of the upper housing 15.

From this state, a further pressing of the lower housing body 15 allows the guide rails 29, 29 to slide along the guide grooves 31, 31 of the upper housing body 15. With this movement of the lower housing body 15 toward the formal stacking position, the end face of the upper housing body 15 is brought into abutment with the second cuff pieces 63 of the contact pieces 53.

Figure 7:
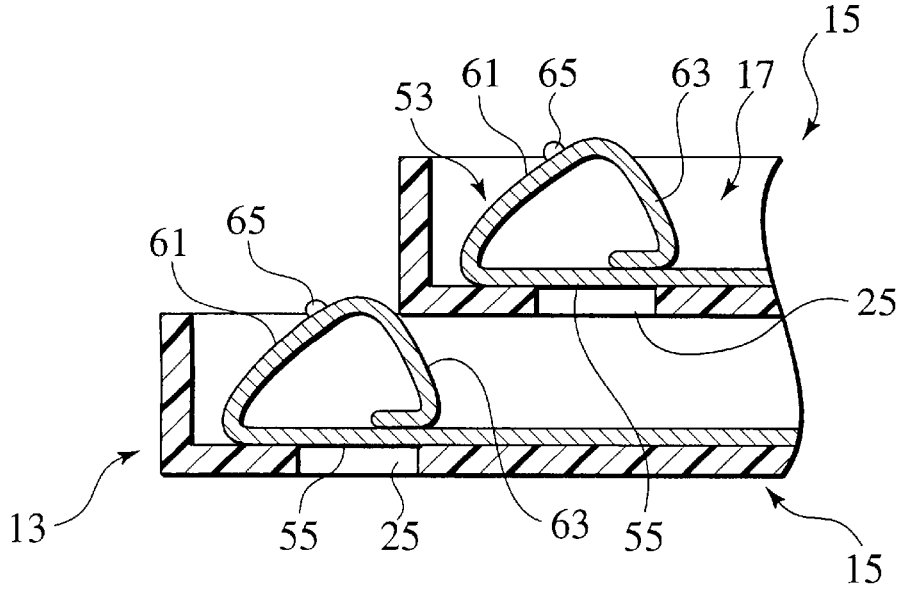
FIG. 7 is a sectional view of a main part of the housing bodies shown in FIG. 6.

When further pressing the lower housing body 15 to slide the guide rails 29, 29 along the guide grooves 31, 31, the second cuff pieces 63 are depressed by the end face of the upper housing body, so that the contact parts 39 bent entirely, as shown in FIG. 7. Thus, the contact parts 39 moves downward by the end face of the upper housing body 15, so that the whole parts 39 are accommodated in the terminal accommodating grooves 19 while allowing the projections 65 to abut against the lower face 27 of the upper housing body 15 due to elasticity of the parts 39. In this state, a further sliding of the lower housing body 15 causes the projections 65 to make a slide contact with the lower face 27 of the upper housing body 15.

Figure 8:
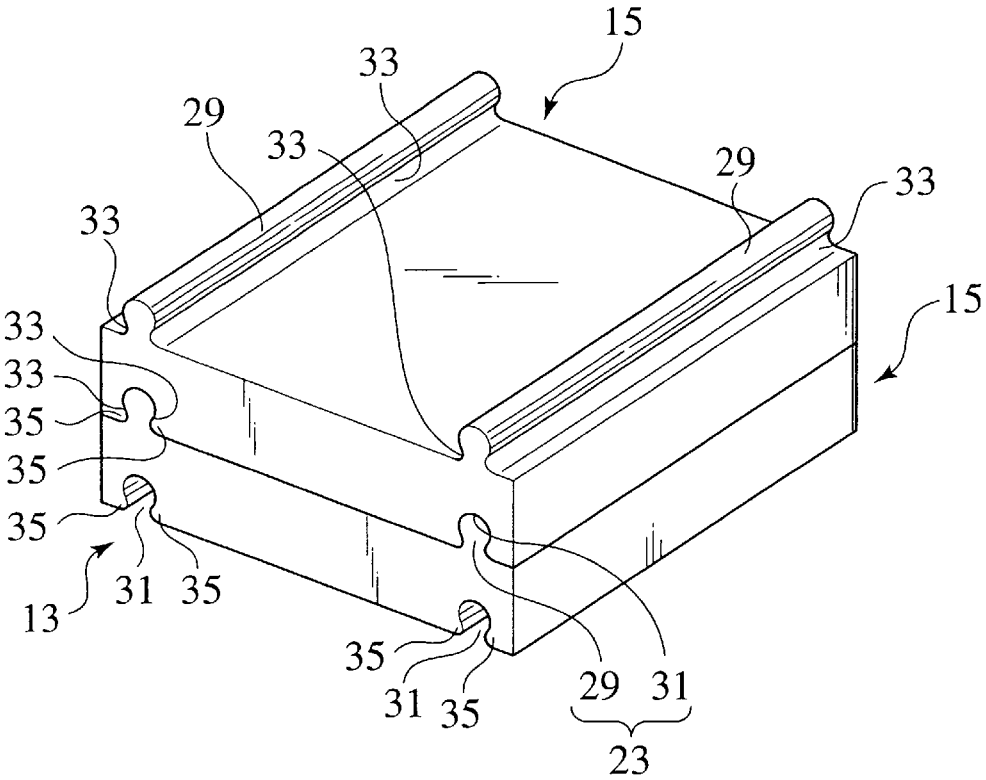
FIG. 8 is a perspective view of a condition where the housing bodies of FIG. 1 are piled in three-stage arrangement.
Figure 9:
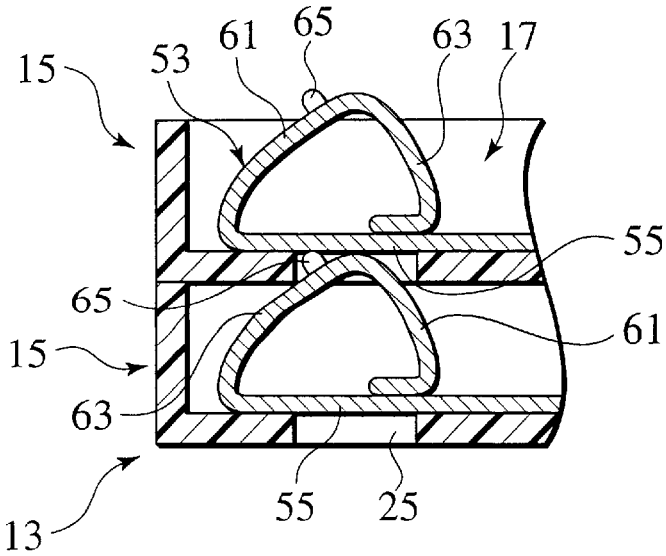
FIG. 9 is a partial sectional view of the housing bodies of FIG. 8, showing the connection between the terminals included therein.

Thereafter, when the lower housing body 15 is guided to the formal stacking position, the guide rails 29, 29 of the lower housing body 15 are fitted to the guide grooves 31, 31 of the upper housing body 15, as shown in FIG. 8 though terminal accommodating grooves 19 and the terminals 17 accommodated therein are not shown in this figure. Then, the engagement of the recesses 33, 33 of the guide rails 29, 29 with the projections 35, 35 of the guide grooves 31, 31 allows the housing bodies 15 to be maintained in their stacking condition. In this state, the lower housing body 15 has the contact parts 53 inserted into the insertion holes 25 of the upper housing body 15, allowing the projections 65 to come into contact with the connecting parts 55 of the upper housing body 15 due to elasticity of the parts 35, as shown in FIG. 9. Consequently, the terminals 17 of the upper and lower housing bodies 15 in the stacking condition are selectively connected with each other. In this way, one housing body 15 is piled on the other housing body 15 and by repeating this operation, there can be provided the joint connector 13 having the housing bodies 15 piled in multistage.

As mentioned above, the joint connector 13 of the embodiment is capable of piling two housing bodies up by sliding the guide rails 29, 29 of the lower housing body 15 in the guide grooves 31, 31 of the lower housing body 15 and also capable of connecting the terminals 17 of the former housing body 15 with the terminals 17 of the latter housing body 15 selectively.

Accordingly, owing to the provision of the alignment mechanism 23, it is possible to guide the lower housing body 15 to the formal stacking position to form a circuit and therefore, there is no conventional need to respectively align the connecting parts with the contact pieces when piling up the housing bodies. Therefore, the damage to the contact pieces 53 in piling up the bodies 15 can be prevented with the simplified piling work, improving the workability in the assembling work.

In the condition where the lower housing body 15 is guided to the formal stacking position, since the recesses 33, 33 of the guide rails 29, 29 of the lower housing body 15 engage with the projections 35, 35 of the guide grooves 31, 31 of the upper housing body 15, such a stacking condition in the bodies 15 can be maintained. Thus, there is no need to provide the joint connector 13 with any fixing means for maintaining the stacking condition, so that the formability of the housing bodies 15 can be improved to save the manufacturing cost.

Additionally, in the same condition, the contact pieces 53 come into elastic abutment with the connecting parts 55 of the terminals 17 of the upper housing body 17, so that the terminals 17 of the bodies 15 in multistage are connected with each other selectively. That is, the lower housing body 15 has only to be guided to the formal stacking position in order to mutually connect the terminals 17 of the bodies 15 stacked in multistage, whereby the number of working process in finishing the joint connector 13 can be reduced.

Owing to the provision of the elastic contact pieces 53, it is possible to prevent them from being damaged in spite of unexpected force. Additionally, in the stacking condition, the elasticity allows the contact pieces 53 to abut against the connecting parts 55 of the upper housing body 15 under pressure, enhancing the electrical connection therebetween.

In the joint connector 13, the arrival of the lower housing body 15 at the formal stacking position causes the contact pieces 53 therein to be accommodated in the terminal accommodating grooves 19 by the guidance of the end face of the upper housing body 15, also allowing of the slide contact of the projections 65 of the pieces 53 with the lower face of the upper housing body 15.

Accordingly, it is possible to reduce an area of slide contact between the contact pieces 53 and the housing body 15, reducing an urging force of the lower housing body 15 when it underlies the upper housing body 15. Thus, the joint connector 13 of the embodiment allows the workability in assembling the housing bodies 15 to be improved.

Further, with the establishment of circuits with high degree of freedom, the joint connector 13 of the embodiment is capable of connection of high reliability between the terminals 17 of the housing bodies 15 stacked in multistage since the sliding direction of the stacked housing bodies 15 is identical to the connecting direction of the terminals 17.

In the first embodiment mentioned above, the sliding direction of the guide rails 29, 29 and the guide grooves 31, 31 is identical to the longitudinal direction of the terminals 17. Alternatively, the sliding direction may be established to intersect the longitudinal direction of the terminals 17.

2nd. Embodiment

The second embodiment will be described with reference to FIGS. 10 and 11. Note, in the embodiment, elements similar to those of the first embodiment are indicated with the same reference numerals respectively and their overlapping descriptions are eliminated.

Figure 10:
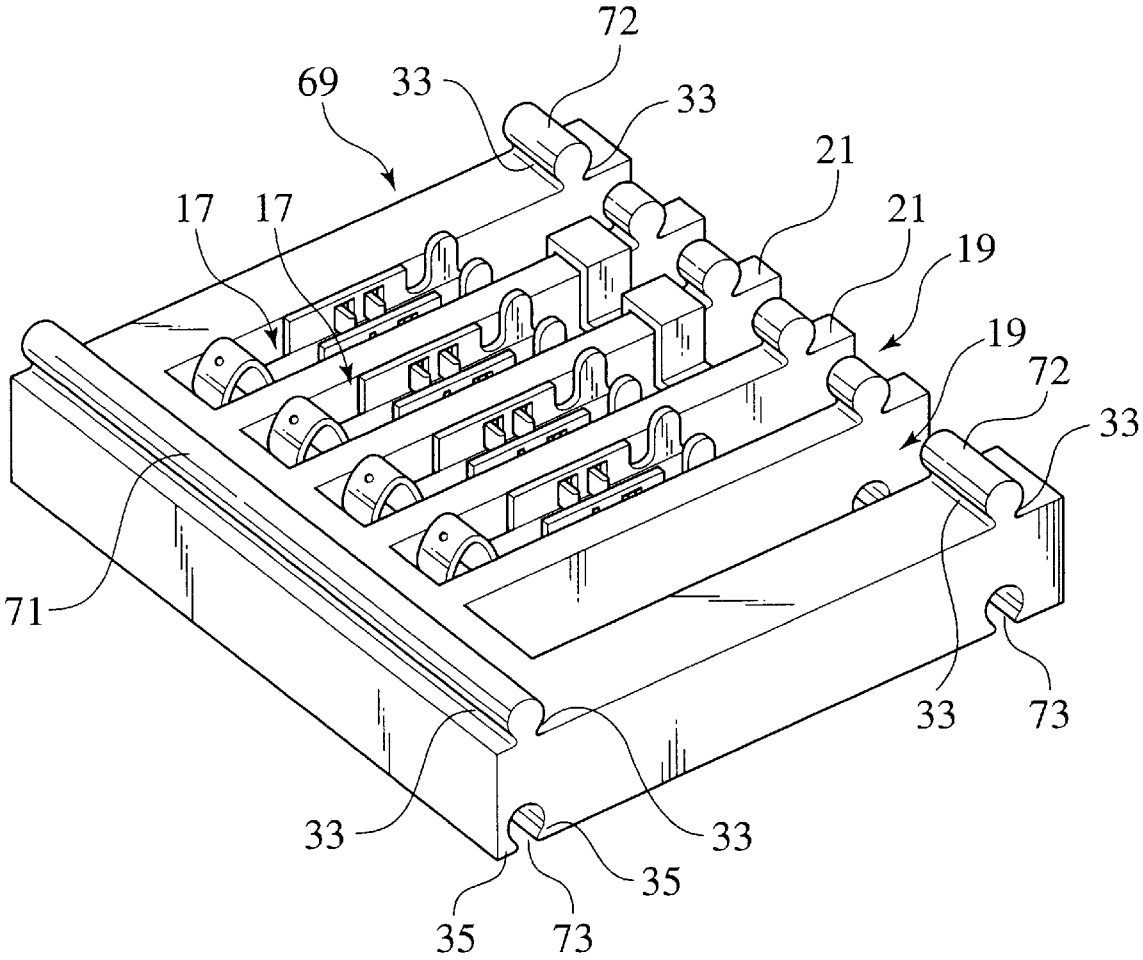
FIG. 10 is a perspective view of one housing body of the joint connector in accordance with the second embodiment of the invention.
Figure 11:
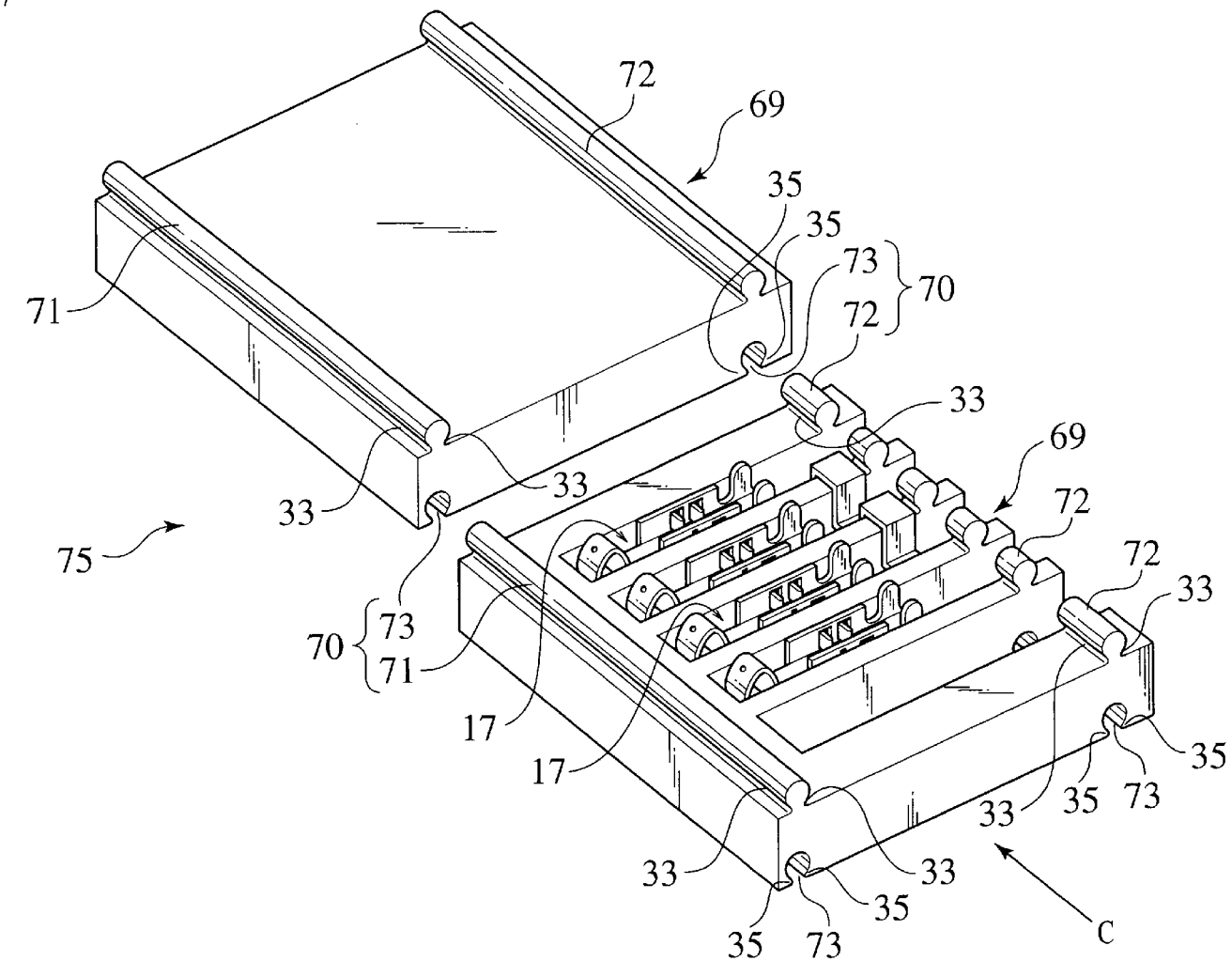
FIG. 11 is a perspective view of the housing bodies shown in FIG. 10, showing a situation to pile them on each other.

FIG. 10 is a perspective view of a housing body 69 constituting a joint connector 75 of the second embodiment of the present invention. FIG. 11 is a perspective view showing a condition to stack the housing bodies 69 of FIG. 10.

As shown in FIG. 10, the joint connector 75 of the embodiment comprises the plural housing bodies 69 (only one shown in the figure) to be piled in multistage and a plurality of terminals 17 built in each housing body 69 so that the adjoining terminals 17 therein are selectively connected with each other. Electrical wires are connected with these terminals 17, respectively. The housing body 69 has the plural terminal accommodating grooves 19 formed therein, the partitions 21 for defining the grooves 19 and an alignment mechanism 70 for guiding the other housing body 69 to be piled thereon to the formal stacking position.

The alignment mechanism 70 has a pair of guide rails 71, 71 formed on the housing body 69 and a pair of guide grooves 73, 73 in which the guide rails 71, 72 of the other housing body 69 underlying the former body 69 slide respectively. The guide rails 71, 72 are in the form of projections of constant sections and also formed on both sides of the upper face of the housing body 69. The guide rail 71 is formed integrally with housing body 69, along the upper face. The other guide rail 72 has rail pieces formed integrally with the partitions 21 and the outside walls of the housing body 69. The guide rails 71, 72 are formed to extend in a direction to intersect the longitudinal direction of the terminal accommodating grooves 19. Further, each guide rail 71, 72 is provided, on its root, with opposing recesses 33, 33.

The guide grooves 73, 73 are formed on both sides of the lower face of the body 69 in a direction substantially parallel with the guide rails 71, 71. The guide grooves 73, 73 are shaped to have respective sections generally equal to or somewhat larger than the sections of the guide rails 71, 72, allowing of the slide movement of the guide rails 71, 72 of the underlying housing body 69. Each of the guide grooves 73, 73 is provided, on its opening side, with inward projections 35, 35 opposing each other.

In order to assemble the joint connector 75 constructed above, fit the terminals 17 on the housing body 69 and build the housing bodies 69 in multistage. In order to pile up the housing bodies 69 in multistage, slide the guide rails 71, 72 of the lower housing body 69 into the guide grooves 73, 73 of the upper housing body 69 to guide the lower housing body 69 to the formal stacking position.

In order to slide the guide rails 71, 72 of the lower housing body 69 into the guide grooves 73, 73 of the upper housing body 69, it is carried out to align the cross sections of the guide rails 71, 72 of the lower housing body 69 with the cross sections of the guide grooves 73, 73 of the upper housing body 69 and further press the lower housing body 69 in the direction of arrow C. Thus, the lower housing body 69 moves in the direction intersecting the longitudinal direction of the terminals 17, so that the guide rails 71, 72 of the lower housing body 69 are respectively inserted into the guide grooves 73, 73 of the upper housing 69. Then, the recesses 33, 33 of the guide rails 71, 72 are engaged with the projections 35, 35 of the guide grooves 73, 73 respectively.

Under such a situation, a further pressing of the lower housing body 69 allows the guide rails 71, 72 to slide along the guide grooves 73, 73 of the upper housing body 69, so that the upper housing body 69 is guided to the formal stacking position along the direction intersecting the longitudinal direction of the terminals 17.

Therefore, in the joint connector 93 of the embodiment, there is no need to give a previous movement of the wires (not shown) connected with the terminals 17 in stacking the housing bodies 69. Accordingly, it is possible to carry out the stacking work of the housing bodies 69 with ease, improving the workability in assembling the joint connector 75.

Note, in the second embodiment, the sliding direction of the housing bodies 69 is perpendicular to the longitudinal direction of the terminals 17. Nevertheless, in the modification, the sliding direction may be oblique to the longitudinal direction of the terminals 17.

3rd. Embodiment

Figure 12:
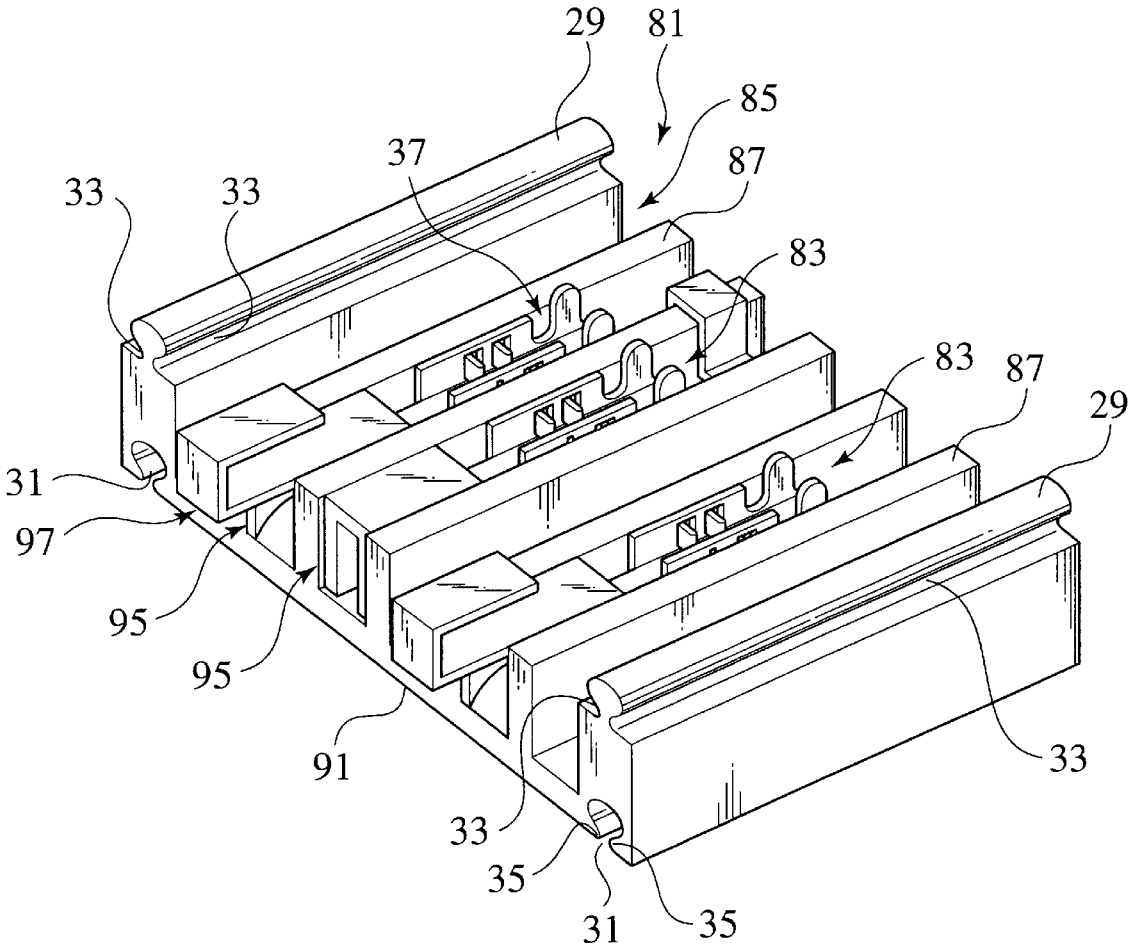
FIG. 12 is a perspective view of one housing body of the joint connector in accordance with the third embodiment of the invention.

With reference to FIGS. 12 to 16, the third embodiment will be described below. Note, in the embodiment, elements similar to those of the first embodiment are indicated with the same reference numerals respectively and their overlapping descriptions are eliminated. FIG. 12 is a perspective view of a housing body 81 constituting a joint connector 93 of the third embodiment of the present invention.

The joint connector 93 comprises the plural housing bodies 81 (only one shown in the figure) to be piled in multistage and a plurality of terminals 83 built in each housing body 81 so that the adjoining terminals 83 therein are selectively connected with each other. The housing body 81 in the form of a box has a plurality of terminal accommodating grooves 85 formed therein, partitions 87 for defining the grooves 85 and the alignment mechanism 23 for guiding the other housing body 81 to be piled thereon to the formal stacking position.

The terminal accommodating grooves 85 are juxtaposed to open upward of the housing body 81. Each of the grooves 85 has an "built-up" opening formed on one side to allow of the insertion of the terminal 83 and another "draw-out" opening formed on the other side to draw a contact piece 97 described later out of the housing body 81. These grooves 85 are respectively defined by partitions 87 each projecting from a lower face 91 of the housing body 81 between the adjoining grooves 85.

The partitions 87 are in the form of rectangular plates each having a length extending from the above "built-up" opening to the above "draw-out" opening. The terminals 83 are accommodated in the so-formed terminal accommodating chambers 85, respectively.

Figure 13:
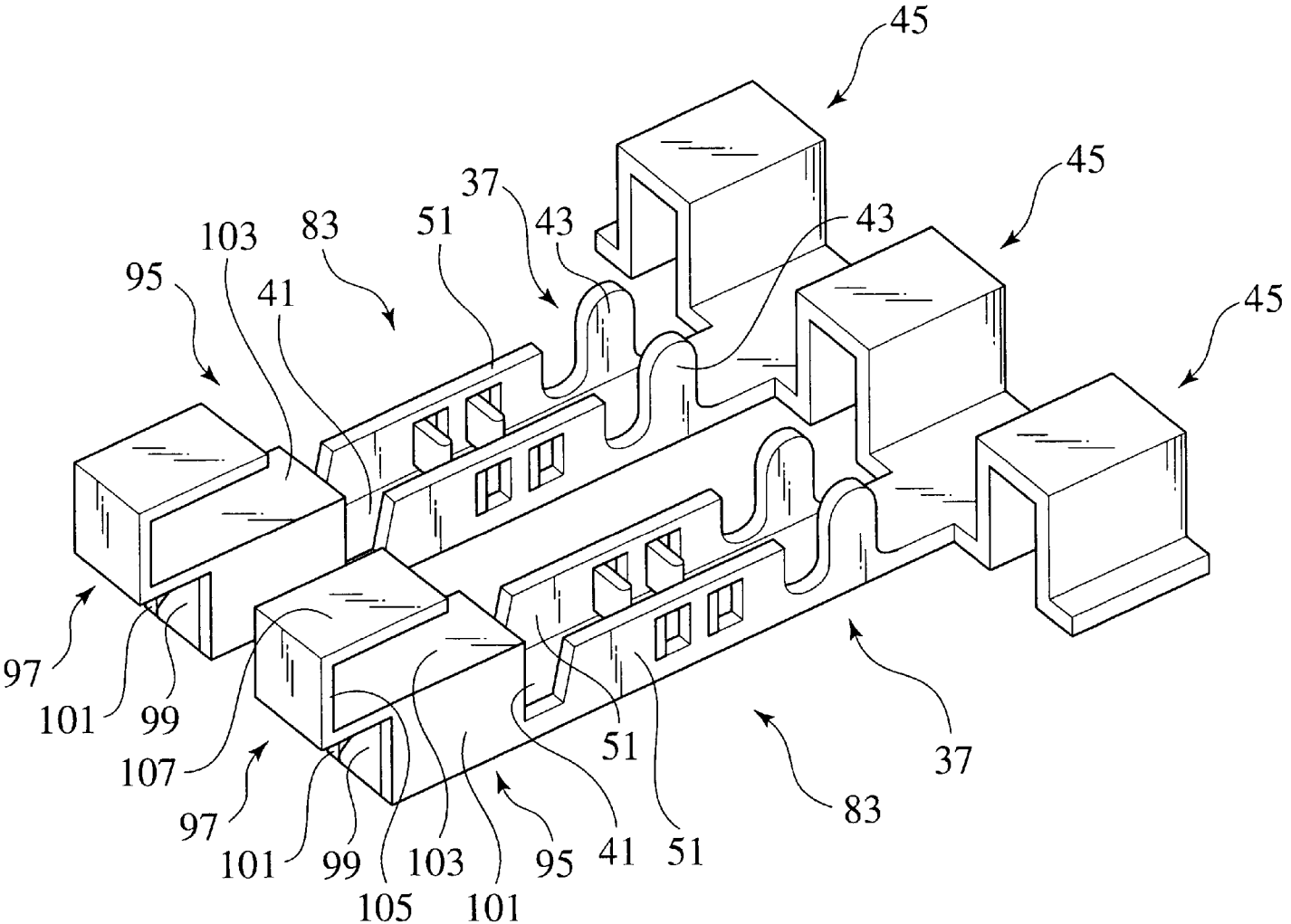
FIG. 13 is a perspective view of a terminal in the joint connector of FIG. 12.

FIG. 13 is a perspective view of the terminals 83 of the joint connector 93 of FIG. 12. Each terminal 83 has a base part 37 formed on one hand and a contact part 95 formed on the other hand. The contact part 95 has a pair of sidewalls 51, 51 formed on both sides of the bottom wall 41, a contact piece 97 formed on the other side of the bottom wall 41 and a connecting part 99 for connection with the contact piece 97 of the underlying terminal 83 of the other housing body 81 underlying the shown terminal 83.

The contact piece 97 includes side plates 101, 101 formed on both sides of the bottom wall 41, a top plate 103 formed on the side plates 101, 101 integrally, a drawer part 105 succeeding to the top plate 103 and an inserting part 107 extending from the drawer part 105 toward the connecting part 45. The side plates 101 and the top plate 103 are shaped to be rectangular plates, respectively. The side plates 101, the top plate 103, the drawer part 105 and the inserting part 107 are all formed into one body.

The drawer part 105 is formed to be a plate having L-shaped cross section. When the terminal 83 is accommodated in the terminal accommodating groove 85, the drawer part 105 is arranged to project out of the housing body 81 through the draw-out opening of the groove 85.

In assembly, the inserting part 107 in the form of a rectangular plate is connected to the connecting part 99 of the other housing body 81 overlying the shown terminal 83.

The connecting part 99 is shaped to be an elastic curved plate folded back from the bottom wall 41. The connecting part 99 is also disposed between the bottom wall 41 and the top plate 103, having a projection 111 formed on an upper face 109 of the part 99.

The projection 111 has a curved face arranged so that a clearance between its face top and the top plate 103 is generally equal to or somewhat smaller than a thickness of the inserting part 107.

In order to provide the joint connector 93 constructed above, first assemble the terminals 83 into each of the housing bodies 81 and thereafter, pile up the housing bodies 81 in multistage.

Figure 14A:
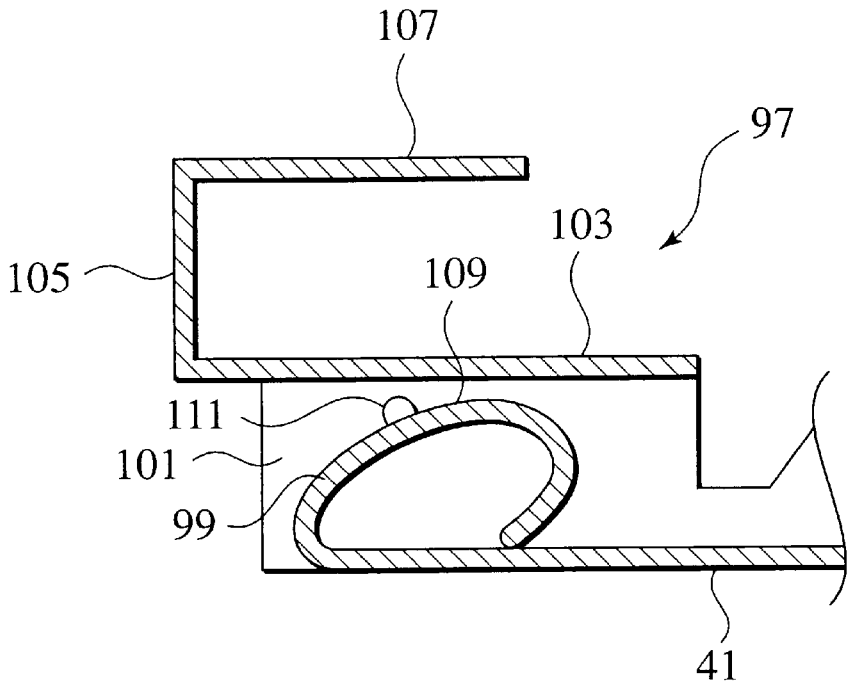
FIG. 14A is a sectional view of the terminal of FIG. 13, also showing a condition before removing the contact piece from the terminal.
Figure 14B:
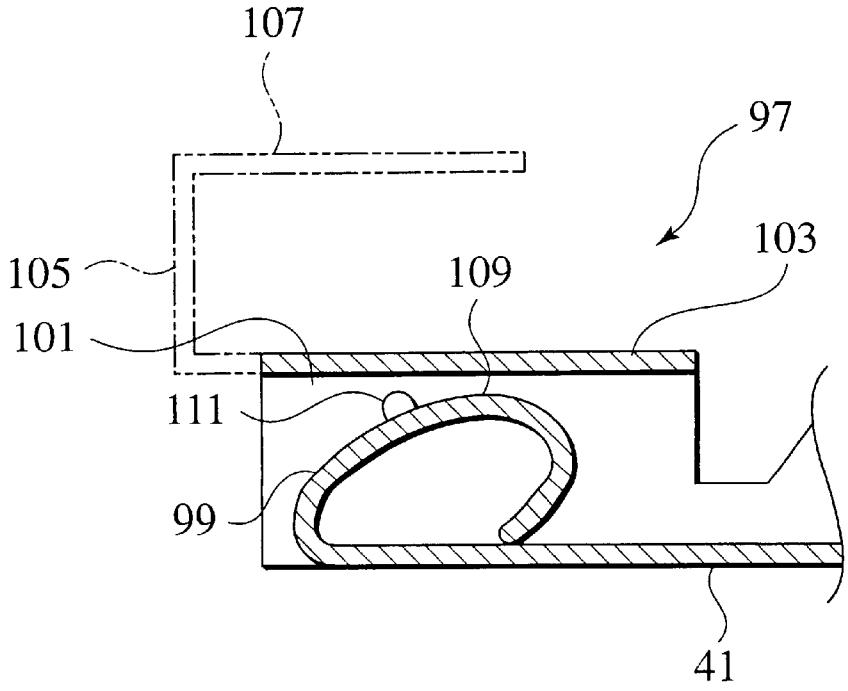
FIG. 14B is a sectional view of the terminal of FIG. 13, also showing a condition after removing the contact piece from the terminal.

When assembling the terminals 83 into the plural housing body 81, as shown in FIGS. 14A and 14B, it is first carried out to cut off the drawer part 105 and the inserting part 107 of the contact piece 97 of the terminal(s) 83 determined in accordance with the design of an electric circuit required. Thereafter, begin to insert the terminals 83 into the terminal accommodating grooves 85, from their sides of the contact parts 95. Then, the insertion of each terminal 83 into the terminal accommodating groove 85 is once stopped at the so-called "incomplete inserting" position where the linking part 45 is not fitted to the partition 87 sufficiently, realizing a temporary accommodating condition.

Next, in accordance with the design of the electric circuit, the linking parts 45 of the terminals 83 are selectively removed at designated positions. Thereafter, the whole terminals 83 are further inserted into the terminal accommodating grooves 85 to their formal inserting positions.

Figure 15:
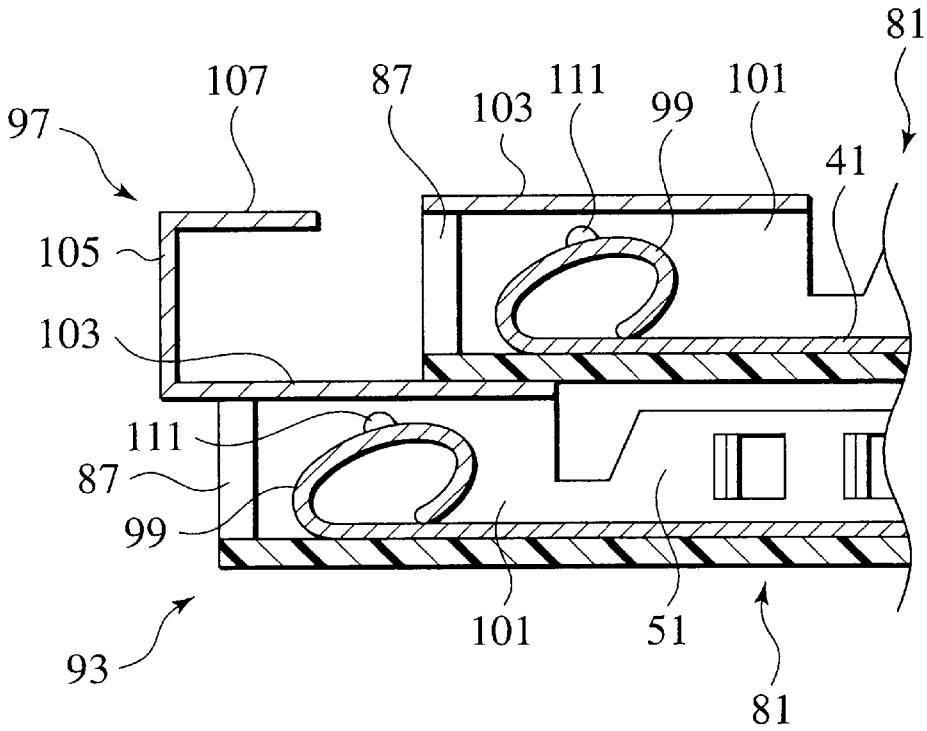
FIG. 15 is a sectional view of the main part of the joint connector, showing a condition before piling the housing bodies of FIG. 12 on each other.

In order to pile the so-assembled housing bodies 81 in multistage, as shown in FIG. 15, it is carried out to slide the guide rails 29, 29 of the lower housing body 81 into the guide grooves 31, 31 of the upper housing body 81 thereby to guide the lower housing body 81 to the formal piling position.

Figure 16:
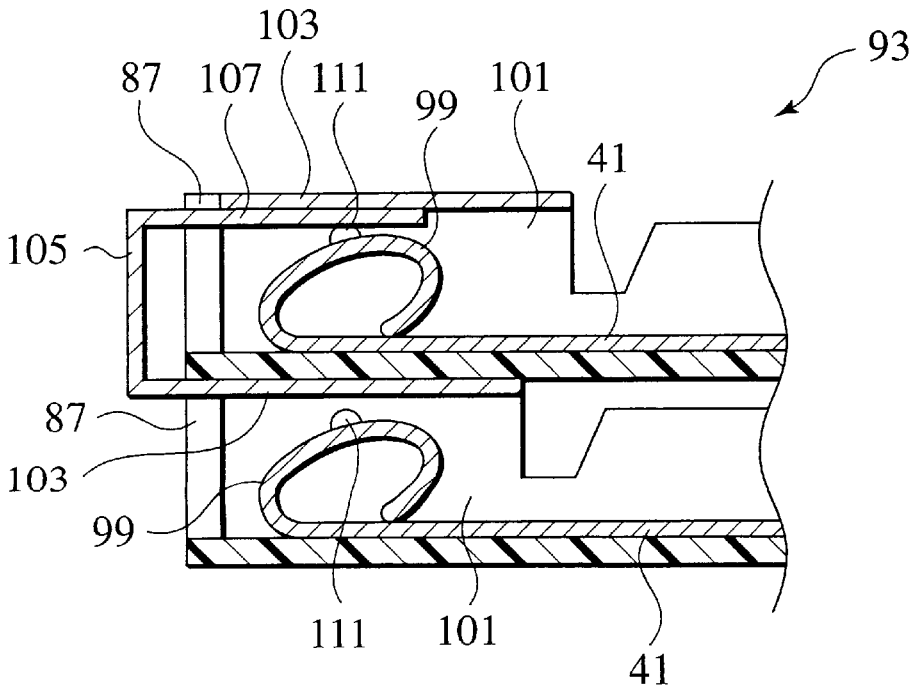
FIG. 16 is a sectional view of the main part of the joint connector, showing the connected terminals under condition of piling the housing bodies of FIG. 12 on each other.

When sliding the guide rails 29, 29 of the lower housing body 81 into the guide grooves 31, 31 of the upper housing body 81, the inserting parts 107 of the contact pieces 97 of the lower housing body 81 come into abutment with the projections 111 of the connecting parts 99. Under such a situation, a further sliding of the lower housing body 81 allows the inserting parts 107 of the lower housing body 81 to press the projections 111 of the connecting parts 97 of the upper housing body 81. Consequently, the connecting parts 99 are bent and displaced downward. Subsequently, when the lower housing body 81 is guided to the formal stacking position as shown in FIG. 16, the inserting parts 106 are respectively inserted between the connecting parts 99 and the top plates 103 upon climb of the parts 106 over the projections 111. In this state, each of the inserting parts 107 has its one side abutting on the top plate 103 and the other side abutting on the elastic connecting part 99. In this way, the terminals 83 of the lower and upper housing bodies 81 in the piling condition are selectively connected with each other.

As mentioned above, since the joint connector 93 of the embodiment can form a circuit on the guidance of the lower housing body 81 to the formal stacking position, it is possible to improve the workability in assembling the connector 93.

4th. Embodiment

Figure 17A:
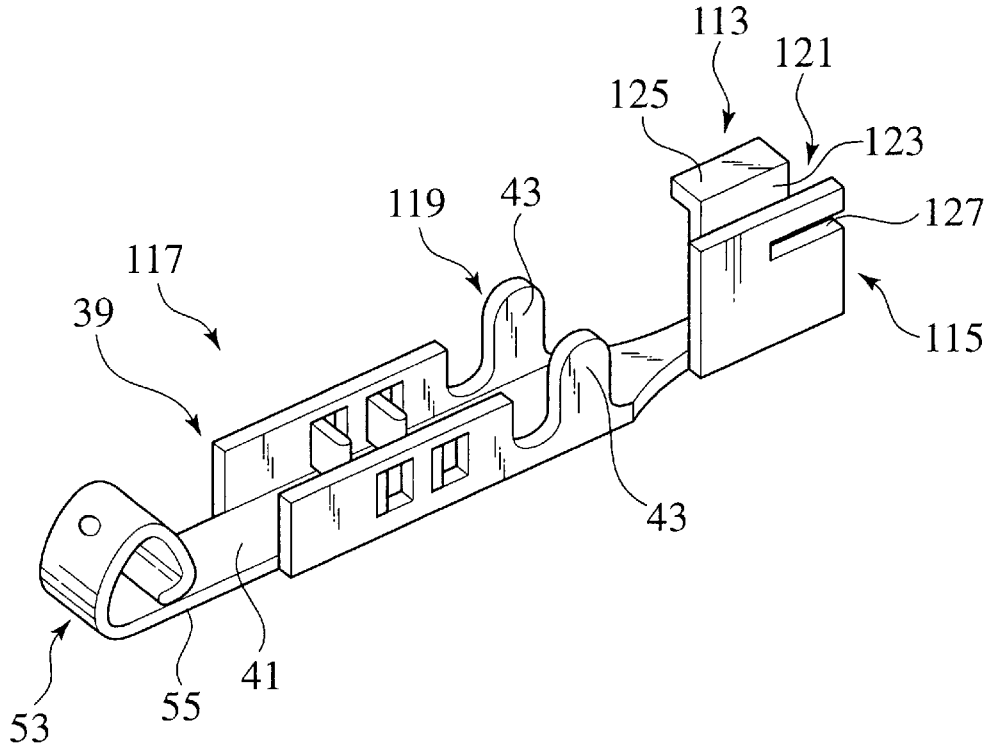
FIGS. 17A and 17B are perspective views of one terminal of the joint connector in accordance with the fourth embodiment of the invention.
Figure 17B:
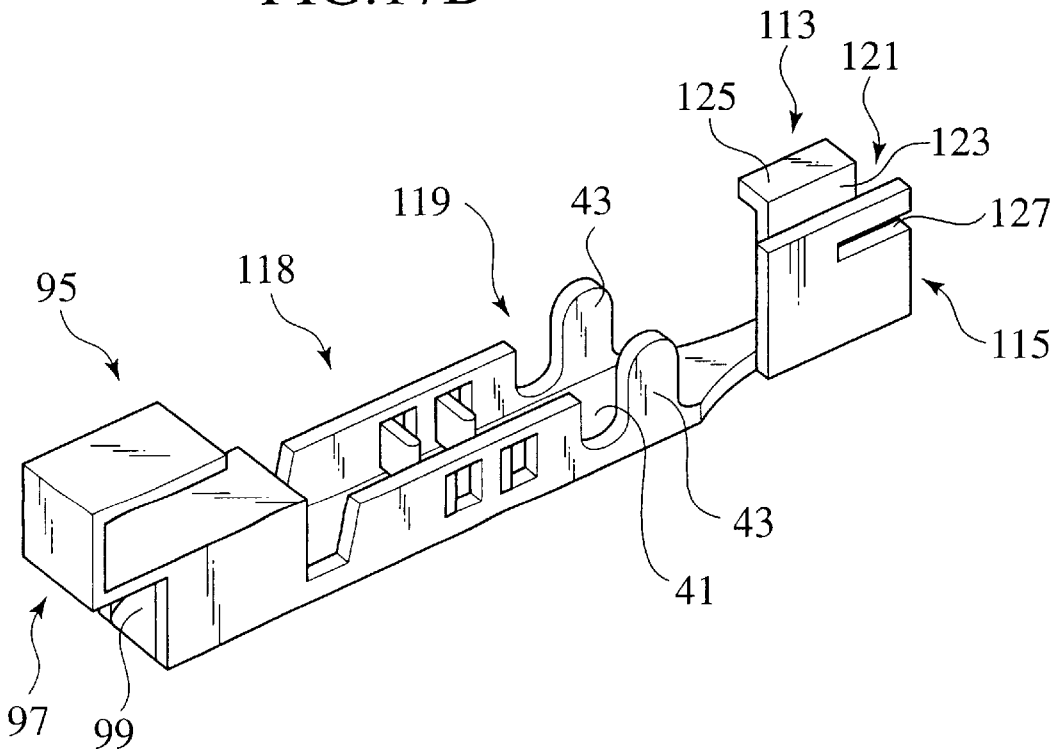
Figure 18:
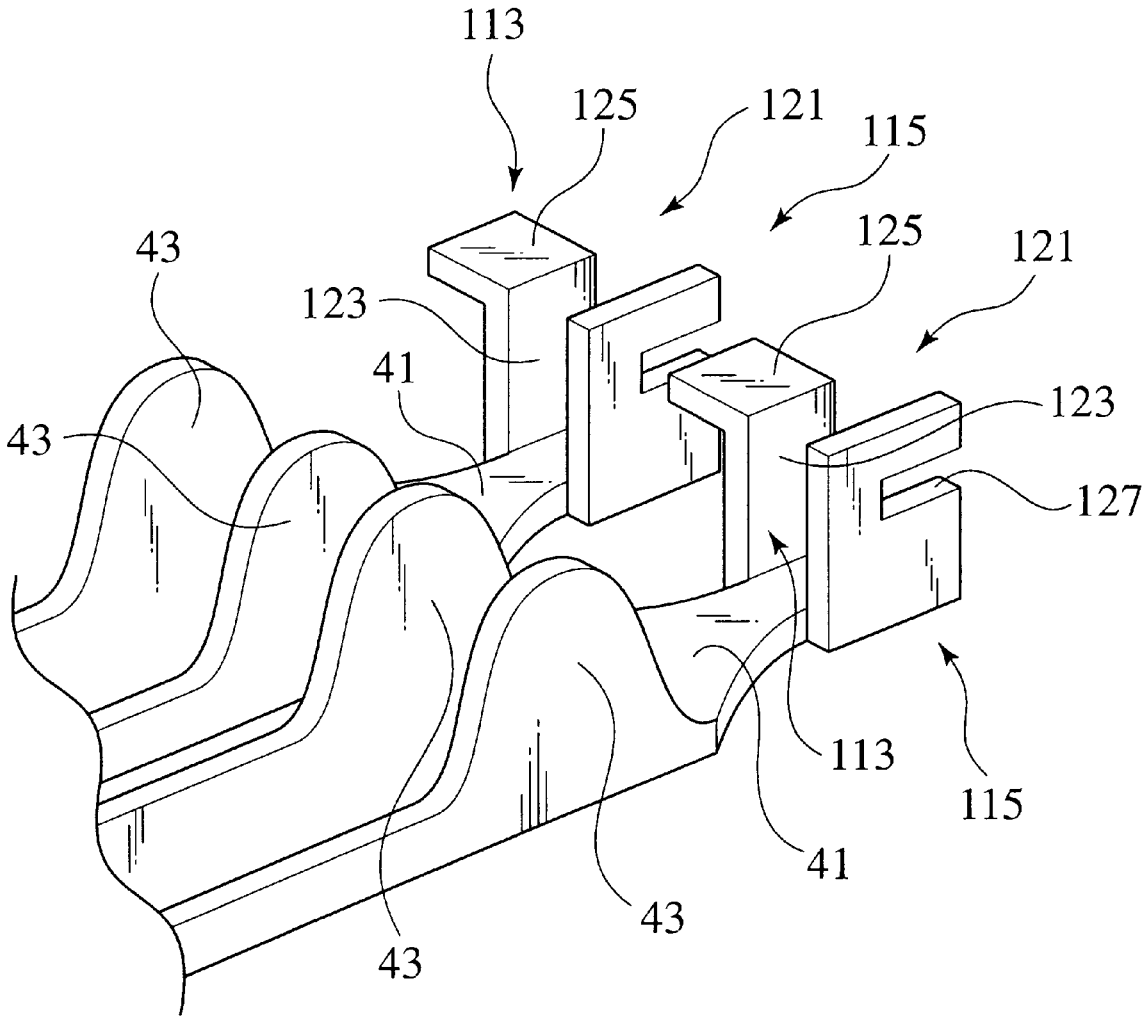
FIG. 18 is a perspective view of connecting parts of the terminals of FIGS. 17A and 17B.

Referring to FIGS. 17A, 17B and 18, the fourth embodiment will be described below. In this embodiment, elements similar to those of the first to third embodiments are indicated with the same reference numerals, respectively and their overlapping explanations are eliminated.

FIGS. 17A and 17B are perspective views showing terminals 117, 118 of the joint connectors 13, 75 and 93, in accordance with the fourth embodiment of the invention. FIG. 18 is a perspective view of linking parts 121 of the terminals 117, 118 of FIGS. 17A and 17B.

As shown in FIGS. 17A, 17B and 18, the terminals 117, 118 have respective base parts 119 and the connecting parts 39, 95. Each base part 119 has the bottom wall 41, the wire-retaining part 43 standing on the bottom wall 41 and the linking part 121 formed at the end of the bottom wall 41.

The linking part 121 has a connecting piece 113 formed on one side of the bottom wall 41 and a press-fit piece 115 formed on the other side of the wall 41. The linking parts 121 are adapted so as to stride over the partitions 21, 87 on condition that the terminals 117, 118 are accommodated in the terminal accommodating grooves 19, 85 respectively. Each connecting piece 113 is in the form of a plate of L-shaped cross section, provided with a vertical plate 123 and a horizontal plate 125. The vertical plate 123 in the form of a plate is formed on one side of the bottom wall 41. The vertical plate 123 projects from the bottom wall 41 upward.

In the form of a rectangular plate, the horizontal plate 125 is formed integrally with the end of the vertical plate 123. The above press-fit piece 115 is provided for connection with the horizontal plate 125 of the neighboring terminal 117 (or 118).

The plate-shaped press-fit piece 115 is formed to project from the bottom wall 41 upward in opposition to the linking piece 113. The press-fit piece 115 is provided, on a general level with the horizontal plate, with a slit 127 extending from the end face of the piece 115 toward the other side.

The vertical width of the slit 127 is generally equal to or somewhat smaller than the thickness of the horizontal plate 125.

In common with the joint connectors 13, 75, 93, the terminals 117, 118 are assembled in the housing bodies 15, 69, 81 and further connected to the neighboring terminals. Thereafter, the housing bodies 15, 69, 81 are piled on each other in multistage.

When assembling the terminals 117, 118 in the housing bodies 15, 69, 81, it is carried out to remove either one or both of the linking piece 113 and the press-fit piece 115 from the terminal 117 (118) in accordance with the design of electric circuit. Next, position the plural terminals 117, 118 between the partitions 21, 81 of the plural terminal accommodating grooves 19, 85. From this state, substantially insert the terminals 117, 118 into the terminal accommodating grooves 19, 85 from the sides of the contact parts 39, 95. Then, the horizontal plate 125 of the terminal 117 (or 118) come into abutment with the opening edge of the slit 127 of the adjoining terminal 117 (118) accommodated in the housing body 15 (69, 81).

Next, when further pressing the terminal 117 (118) into the formal inserting position, the horizontal plate 125 is inserted into the slit 127 under pressure while the whole terminal 117 (118) is accommodated into the terminal accommodating groove 19 (85). By repeating the above-mentioned operations, there can be finished the housing body 15 (69, 81) having the plural terminals 117, 118 accommodated therein where the neighboring terminals 117, 118 are selectively connected with each other.

As mentioned above, according to the joint connector of the embodiment, the connection between the linking piece 113 of the terminal 117 (118) and the press-fit piece 115 of the neighboring terminal 117 (118) allows the adjoining terminals 117, 118 to be connected with each other. Thus, in transporting the terminals 117, 118, they can be separated from each other while preventing the linking parts 121 from being deformed by an expected force.

Again, it will be understood by those skilled in the art that the foregoing descriptions are nothing but one embodiment of the disclosed joint connector and the modifications. In addition to the above modifications, various changes and modifications may be made to the present invention without departing from the spirit and scope of the invention.

What is claimed is:

1. A joint connector comprising:

a plurality of housing bodies adapted to be piled on each other, the housing bodies each having a plurality of terminal accommodating grooves juxtaposed therein;

a plurality of terminals accommodated in the terminal accommodating grooves of the housing bodies, respectively, wherein at least one of the terminals is connected with the neighboring terminal through a linking part, the terminals for each of the housing bodies having respective contact pieces formed to project out of a related housing body selectively and also having respective connecting parts formed for connection with the contact pieces of a lower housing body which is arranged under the related housing body; and an alignment mechanism formed for each of the housing bodies to guide the other housing bodies arranged over and under the related housing body to respective formal stacking positions established thereon.

2. A joint connector as claimed in of claim 1, wherein each of the contact pieces of the terminals has a drawer part formed to project out of the related housing body and an inserting part formed in succession with the drawer part toward the linking part; and each of the connecting parts is adapted so as to come into elastic abutment with the inserting part of the terminals in the lower housing body arranged under the related housing body.

3. A joint connector as claimed in claim 1, wherein the linking part has a linking piece and a press-fit piece allowing the linking piece of the neighboring terminal to insert thereinto to link the terminal to the neighboring terminal.

4. A joint connector as claimed in claim 1, wherein the alignment mechanism comprises:

guide rails formed on the related housing body to guide the upper housing body piled thereon; and guide grooves formed in the related housing body, for slide engagement with the guide rails of the lower housing body arranged under the related housing body, thereby to allow the lower housing body to be guided to the formal stacking position.

5. A joint connector as claimed in claim 4, wherein the guide rails of the lower housing body are engaged in the guide grooves of the related housing body, thereby completing a condition where the related housing body is piled on the lower housing body.

6. A joint connector as claimed in claim 4, wherein there is established a sliding direction of the guide rails between the guide grooves of the related housing body and the guide rails of the lower housing body engaging the guide grooves, the sliding direction intersecting longitudinal directions of the terminals.

7. A joint connector as claimed in claim 1, wherein the contact pieces of the related housing body are connected with the connecting parts of the terminals accommodated in the upper housing body piled on the related housing body, elastically.

8. A joint connector as claimed in claim 7, wherein the contact pieces of the terminals accommodated in the related housing body are provided, thereon, with projections for electrical connection with the connecting parts of the terminals accommodated in the upper housing body.

* * * * *